United States Patent [19]

Gudat et al.

[11] Patent Number: 4,523,513

[45] Date of Patent: Jun. 18, 1985

[54] PNEUMATIC DOOR-OPERATING ARRANGEMENT

[75] Inventors: Wolfgang Gudat, Hanover; Alfred Klatt, Wathlingen; Gunter Sebesta, Hemmingen, all of Fed. Rep. of Germany

[73] Assignee: WABCO Westinghouse Fahrzeugbremsen GmbH, Hanover, Fed. Rep. of Germany

[21] Appl. No.: 507,820

[22] Filed: Jun. 27, 1983

[30] Foreign Application Priority Data

Jul. 8, 1982 [DE] Fed. Rep. of Germany ..... 3225536

[51] Int. Cl.[3] ..... F15B 11/10; F15B 13/043; E05F 15/02

[52] U.S. Cl. ..... 91/427; 91/433; 91/446; 91/448; 91/453; 91/459; 91/464; 91/465; 137/596.15; 137/596.16; 49/28

[58] Field of Search ..... 91/427, 433, 446, 448, 91/453, 459, 464, 465, 318; 137/596.15, 596.16, 596.14; 49/28, 265

[56] References Cited

U.S. PATENT DOCUMENTS

| | | | |
|---|---|---|---|
| 2,485,252 | 10/1949 | Almond | 91/427 X |
| 2,630,828 | 3/1953 | Bent | 91/464 X |
| 3,316,930 | 5/1967 | Gardner | 137/596.16 X |
| 3,908,515 | 9/1975 | Johnson | 91/464 X |
| 4,257,455 | 3/1981 | Cameron | 137/596.16 |
| 4,369,696 | 1/1983 | Klatt et al. | 91/465 |

FOREIGN PATENT DOCUMENTS

| | | | |
|---|---|---|---|
| 2926218 | 1/1981 | Fed. Rep. of Germany . | |
| 3020972 | 12/1981 | Fed. Rep. of Germany | 49/28 |

*Primary Examiner*—Irwin C. Cohen

*Attorney, Agent, or Firm*—George E. Hawranko

[57] ABSTRACT

A pneumatic door control equipped with a door control valve for operating a door drive to an open or a closed position. The door control valve has an opening and a closing solenoid-operated pilot valve and an opening and closing spool valve, each operable to a passage or a vent position. A shuttle valve is part of the control valve and works in conjunction with an operator-controlled emergency valve to vent both spool valves simultaneously. A differential pressure switch is connected to the door drive to sense abnormal pressure expended in a door-opening or closing movement. Such an occurrence will output a signal to an electronic switching device which also monitors, via limit switches, whether a door is fully opened or fully closed. If excess pressure occurs during a door-closing movement, the switching device will trigger the control valve to reverse to the opening position. If excess pressure occurs during an opening movement, the switching device triggers both solenoid-operated pilot valves simultaneously. The control valve has a non-return valve which recognizes the dual triggering condition and outputs to the shuttle valve so that the two spool valves can be vented simultaneously. A throttle valve is disposed between the emergency valve and control valve for restricting the flow of pressurized air following an emergency condition.

18 Claims, 2 Drawing Figures

PNEUMATIC DOOR-OPERATING ARRANGEMENT

BACKGROUND OF THE INVENTION

The invention relates to a pneumatic door-operating arrangement with an electropneumatic control device, especially for doors in vehicles which are used for transporting people.

Door operation installations are, as a rule, controlled pneumatically or electropneumatically, i.e., to open or close the door the driver triggers a pneumatic or electrical pulse, which, by means of a control valve (also called a door valve), acts on a door cylinder (also called door drive) with compressed air, whereby the stroke movements of the door cylinder piston trigger the opening and closing movements of the door.

A general requirement of such an installation is that a closing door automatically switch into an opening movement if persons or objects are caught in the door, or that the installation automatically become depressurized if persons or objects are caught in an opening door.

There is an additional requirement that when a door operation device which has been vented by means of an emergency valve is re-pressurized, it does not produce a sudden movement of the door, so that there are no damages to the door or injuries to persons.

A pneumatic door operation device of the type described above, which fulfills the safety requirements mentioned above, is known from the unpublished German Patent Application No. P 31 18 764.1 (copending U.S. application Ser. No. 386,550). In this installation, the functions of a door valve and the valve apparatus which produces the safety functions described above are combined in one valve combination. However, one disadvantage with this installation is that when there is a break in the electrical cable system, or a failure of magnetic forces, there can be an undesirable drop in the installation pressure. Even an inadvertent extraction of the ignition key can cause such a pressure drop. This disadvantage results from the fact that the door must be opened and held open by means of a constant electrical current, and that, for this reason, the corresponding pressurizing valve must be opened or held open against the force of a spring. When the electrical current fails, the valve element of the pressurizing valve returns to its original venting position under the force of the spring, so that there can be a pressure drop in the above-mentioned door operation installation.

SUMMARY OF THE INVENTION

The object of the invention, therefore, is to provide a pneumatic door-operating arrangement utilizing a pneumatic door valve which adheres to the above-mentioned safety considerations including the safe door operation at a time of an electrical malfunction.

It is a further object of this invention to provide such an arrangement and device by simple means and without significant added expenditures.

It is still a further object of this invention to control the door-opening and closing movements by means of pulses, thereby eliminating the need for the mechanical tension force of a spring to keep the closing force of the door constant should there be a sudden pressure drop in the system due to an electrical failure.

Briefly, the invention consists of a door control valve used in a pneumatic door-operating arrangement whereby, under normal operating conditions, pressurized fluid supplied from a storage tank, flows through an emergency valve in the non-emergency position, then through a throttle valve in the non-throttled position, and then to a primary inlet of the door control valve. The door control valve is constructed of an essentially symmetric architecture wherein one of two 3/2-way solenoid valves operates to an open position, thus allowing the pressurized fluid to flow to either the opening chamber or the closing chamber of a door drive cylinder, depending on the triggered input and the safety conditions existing at the time. A differential pressure switch, connected to both chambers of the door drive cylinder for detecting an excessive amount of pressure expended in a door movement, can initiate an electrical signal to an electronic switching device which would then initiate a pulse to the proper solenoid valve to interrupt flow. Also connected to this electronic switch device are limit switches which detect the end position of the doors, and, a push button used by the operator to initiate a door movement.

Further constructed as part of the door control valve is a shuttle valve which causes venting of both door drive cylinder chambers when pressurized fluid is directed to an emergency inlet by the emergency valve. A non-return valve, also constructed as part of the door control valve, operates in conjunction with the limit switch and electronic switching device for venting the opening chamber should the limit switch be tripped during an opening movement, and for preventing reversal to a closing movement at this time.

DESCRIPTION AND OPERATION

Figure 1:
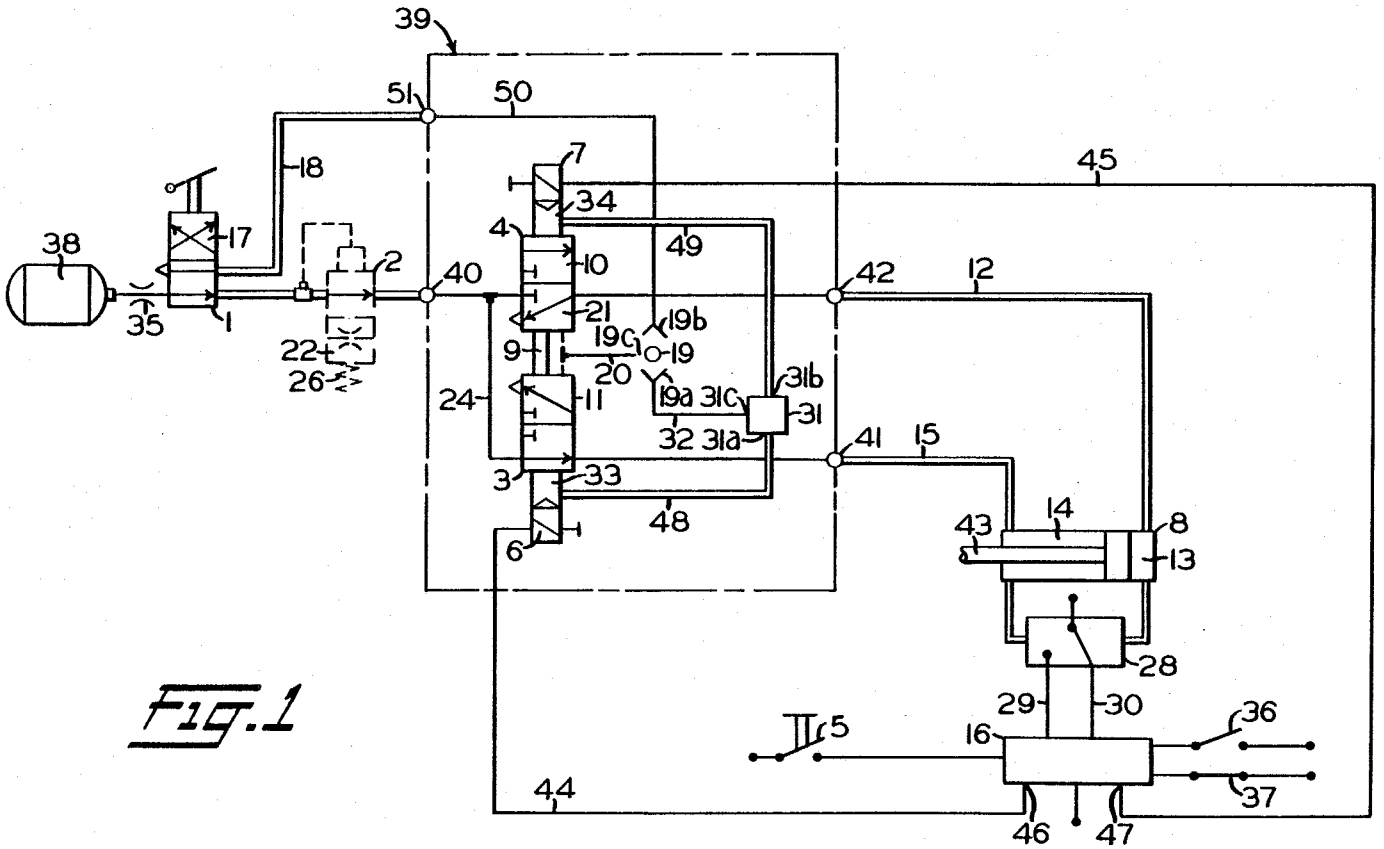
FIG. 1 is a diagrammatic illustration of an electropneumatic door-operating arrangement embodying the invention.

As shown in FIG. 1, the electropneumatic door-operating arrangement embodying the invention consists of a storage tank 38 which is connected via a throttle 35, to an emergency valve 1, a throttle valve 2 and to an electropneumatic door control valve 39 by way of a primary inlet 40. Via a first and a second outlet 41 and 42 and first and second pneumatic lines 15 and 12, the door control valve 39 is connected to the door drive cylinder 8, which in the example described here, is designed as a double-acting cylinder, having two chambers 13 and 14, one of which is a door-opening chamber 13, and the other a door-closing chamber 14, as well as a piston 43. The door control valve 39 is formed by two 3/2-way solenoid valves, 3 and 4, a shuttle valve 19, and a non-return valve 31, all structured within the housing 52 of the door control valve 39.

The non-return valve 31 exhibits two inputs **31*a* and 31*b* and one output 31*c* whereby the output 31*c* is only pressurized if the inputs 31*a* and 31*b*** are simultaneously pressurized.

The first 3/2-way solenoid valve 3 is used for the pneumatic control of the door-closing chamber 14 of the door drive cylinder 8 through the first outlet 41 and the first pneumatic line 15. The second 3/2-way solenoid valve 4 is provided for the pneumatic control of the door-opening chamber 13 through the second outlet 42 and the second pneumatic line 12.

For the control of the door valve 39, there are electrical lines 44 and 45 between the electromagnets 6, 7 of the 3/2-way solenoid valves 3, 4 and electrical terminals 46, 47 of an electropneumatic or electronic switching device 16, which is activated by means of a button 5. An electropneumatic safety switch 28 is connected between the chambers 13 and 14 of the door drive 8 and the switching apparatus 16 by means of electrical switch lines 29 and 30. Limit switches 36, 37 connected with the switching device 16 serve the purpose of shutting off the safety functions when the door has reached its appropriate limit position.

The non-return valve 31 integrated into the door control valve 39 is connected via the inlets 31*a*, 31*b* and the pilot passageways 48, 49 with pilot valves 33, 34 of the 3/2-way solenoid valves 3, 4 and via the outlet 31*c* and a shuttle passageway 32 with an inlet 19*a* of a similarly-integrated shuttle valve 19, provided with two inlets 19*a*, 19*b*. The other inlet 19*b* of the shuttle valve 19 is connected via an emergency passageway 50, an emergency inlet 51, and an emergency line 18, with the emergency valve 1. The outlet 19*c* of the shuttle valve 19 is in communication via a piston passageway 20 with a piston chamber 60 located between the valve pistons 61, 62 of the valves 3 and 4. Opposite ends of the pistons 61, 62 abut forming mechanical connection 9 which, when one of the 3/2-way solenoid valves 3 or 4 is switched to a passage position, the other 3/2-way solenoid valve is switched to the vent position but, if pressure is applied at this mechanical connection 9, the pistons both separate to the vent position.

The operation of the pneumatic door-operating arrangement is as follows:

The switch positions of the symbols show the installation with the door closed, i.e., the door-closing chamber 14 of the door drive 8 is pressurized by means of the emergency valve 1, the unthrottled throttle valve 2 and the first 3/2-way solenoid valve 3 opened for passage. At the same time, the door-opening chamber 13 is vented via the second pneumatic line 12 and the second 3/2-way solenoid valve 4 in the ventilation position.

To open the door, the button 5 is activated, and the switching device 16 transfers an electrical pulse via the second electrical line 45 to the magnet 7 of the second 3/2-way solenoid valve 4. The valve 4 switches to the open position 10. At the same time, the first 3/2-way solenoid valve 3 is switched by means of the mechanical connection 9 into the closed position 11. Air from the storage tank 38 flows via the second pneumatic line 12 into the opening chamber 13 of the door drive 8. The closing chamber 14 vents via the first pneumatic line 15 into the atmosphere. The door is opened.

If the emergency valve 1 is switched from its normal position into the emergency position 17, air from the storage tank 38 flows via the emergency line 18, emergency inlet 51, emergency passageway 50, connection 19*b* of the shuttle valve 19 and the piston passageway 20 into the piston chamber 60 located between the ends of the valve pistons 61, 62 of the valves 3 and 4. The valve 4 switches into the dual-venting position 21 and vents the second pneumatic line 12, which is under pressure.

If the emergency valve 1 is switched into the emergency position 17, and if the closing chamber 14 of the door drive 8 has previously been pressurized, the valve 3 switches into the closed position 11, and vents the first pneumatic line 15. The door drive 8 is thus completely ventilated with the switching of the emergency valve 1 from the normal into the emergency position.

The door-operating arrangement is put back into operation by the dispatch of a pulse via the button 5. The valve 4 thereby switches into the opening position 10, so that the second pneumatic line 12 is pressurized. On account of the lack of counterpressure in the closing chamber 14 following an emergency switching of the emergency valve 1, the pressure flowing from the emergency valve 1 to the throttle valve 2, is lower than during a normal operation, so that the spring 26 of the throttle valve 2 holds the valve 2 in the throttled position 22.

With a low flow resistance of the emergency valve 1, it may be necessary that, for a throttled door movement, a throttle 35, as shown here, is necessary.

The safety circuit embodied in this example of the invention works on the differential pressure principle. If, for example, the pressure in the closing chamber 14 exceeds a defined value, as when the door strikes an object, then the magnet 7 receives a pulse via the safety switch 28, the electrical switch line 29 and the switch device 16, so that the valves 3 and 4 reverse. The door thereby changes the direction of its movement, i.e., it re-opens.

If, however, the pressure in the opening chamber 13 exceeds a defined value, then both the magnet 7 and the magnet 6 each receive, via the electrical switch line 30 and the switch device 16, an electrical pulse, so that, by means of the pilot valves 33, 34, the pneumatic non-return valve 31 pressurizes the shuttle passageway 32, the shuttle valve 19 and the piston passageway 20, the end surface of the valve piston 62 of valve 4, which thereby reverses into the dual-venting position 21, and vents the pressurized line 21, which thereby becomes depressurized. This measure is necessary here because a door in the process of opening should not necessarily reverse, since other persons can be injured in the subsequent reversing movement.

The door-operating arrangement can, as after an emergency switching, be put back into operation by pushing the button 5.

The functions "shutoff" or "reversal" of the door drive—as mentioned above—are based on the determination of increased pressure differences between the two sides of the door drive piston 43 during a door movement. These functions must therefore be rendered ineffective, both in the fully opened and also in the fully closed positions of the door, by the limit switches 36 and 37 provided for this purpose.

Figure 2:
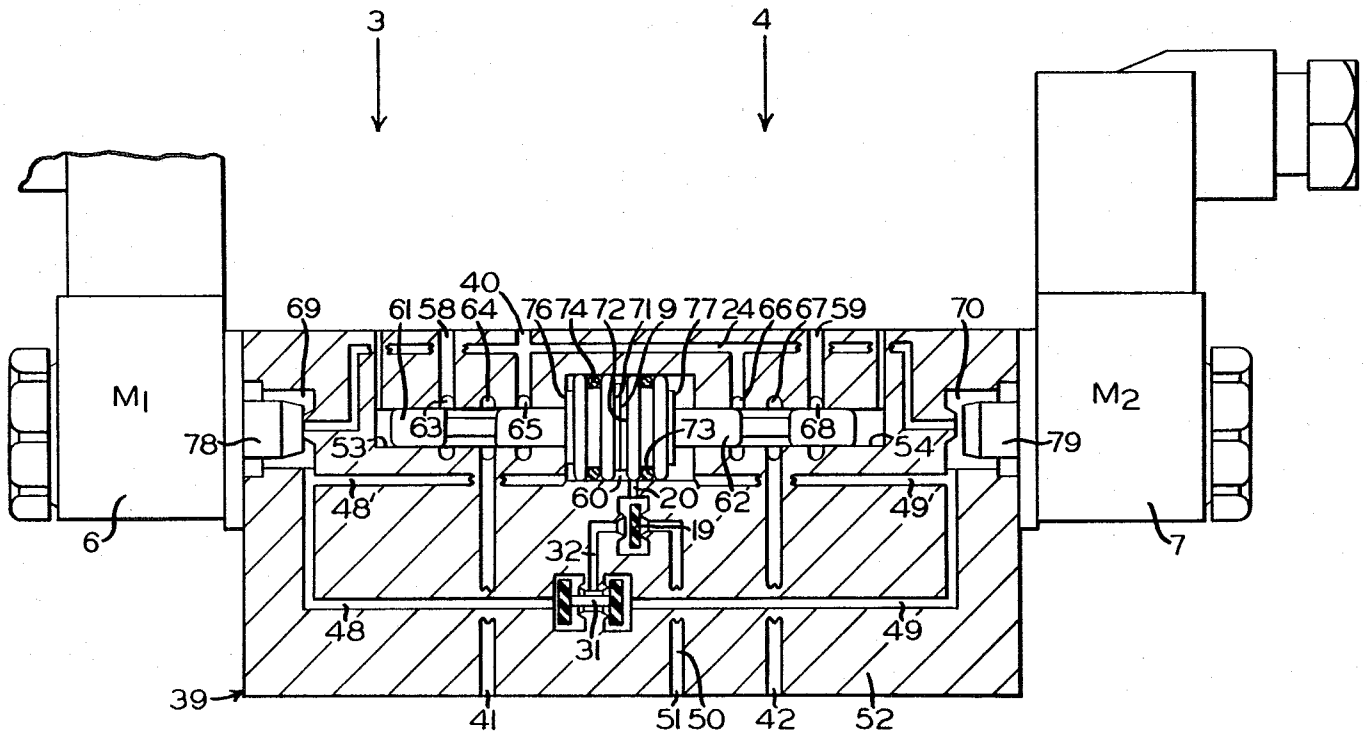
FIG. 2 is a sectional view of an electropneumatic door control valve embodied in the invention.

The drawing in FIG. 2 shows a door valve 39 in the opened position, which contains two 3/2-way solenoid valves 3, 4, a non-return valve 31, and a shuttle valve 19, all together as a valve combination in a housing 52. The first 3/2-way solenoid valve 3 is assigned to the closing chamber 14 of a door drive 8 (not shown), while the second 3/2-way solenoid valve 4 is assigned to the door-opening chamber 13. The valve switching elements of the 3/2-way solenoid valves 3, 4 are designed as pneumatic circuit pistons 61, 62, and are located in bores 53, 54 formed in the housing 52 adjacent one another in such a way that, by means of the end surfaces 71 and 72 of the pistons 61 and 62, a mechanical connection 9 of these pistons 61 and 62 can be produced. Between the end surfaces 71 and 72, there is a pneumatic piston chamber or contacting chamber 60, which is sealed on both sides of the pistons 61, 62 by means of piston sealing rings 73 and 74.

As shown in the illustration, a primary inlet 40 for air from the reservoir 38 (not shown), is connected via a throttle valve 2, an inlet passageway 24, annular chambers 64 and 65 of the piston 62 of the second 3/2-way solenoid valve 4, with a second outlet 42, so that the opening chamber 13 of the door drive 8 (not shown) in this position (door-opening position) is acted upon by compressed air. A first outlet 41 connected with the closing chamber 14 of the door drive 8, is thereby vented via annular chambers 67 and 68 of the piston 61 of the first 3/2-way solenoid valve 3 and a first vent opening 58, leading to the atmosphere. A corresponding second vent opening 59 leading to the outside is assigned to an annular chamber 63 of the second piston 62 of the second 3/2-way solenoid valve 4. The annular chambers 69 and 70 as well as the pilot passageways 48, 48' and 49, 49' are connected by means of vents (not shown) of the magnets 6, 7 of the 3/2-way solenoid valves 3, 4 with the atmosphere. Between the pilot passageways 48 and 49, there is a non-return valve 31, which, when there is a pressure equilibrium in the pilot passageways 48 and 49 , keeps the connection open between the two pilot passageways 48 and 49, and also a shuttle passageway 32 leading to the shuttle valve 19. For the alternating movement of the shuttle valve 19, there is the emergency passageway 50, which is in connection via an emergency inlet 51, with the air supply introduced via an emergency valve (not shown). On the outlet side, the shuttle valve 19 is in connection with the piston chamber 60 located between the end surfaces 71 and 72 of the pistons 61 and 62.

The pilot passageways 48' and 49' serve as the admission fo the annular surfaces 76 and 77 of the pistons 61 and 62 in the pressure direction opposite to that of the pressure in piston chamber 60. The end portions of inlet passageway 24 are sealed off by the solenoid valve elements 78 and 79 from the annular chambers 69 and 70, until the magnets 6, 7 are momentarily energized by the electrical pulse.

The operation of the door valve is as follows:

As mentioned previously and as shown in FIG. 2, the door control valve is in the opened position. This has occurred by the closing of the electrical circuit to the second magnet 7 which causes the second solenoid valve element 79 to attract allowing pressure to flow through pilot passageways 49 and 49'. The non-return valve 31 is in the opened position and, by action on the second annular surface 77 of the second piston 62, the pistons 61 and 62 have assumed the positions shown wherein the primary inlet 40 is connected to the second outlet 42 via the inlet passageway 24 and the annular spaces 66 and 67. Simultaneously, the first outlet 41 is vented to atmosphere via the annular spaces 64 and 63 and the first vent opening 58.

When the electrical pulse ends and the second solenoid valve element 79 returns to the seated position, the pilot passageways 49 and 49' are vented through magnet vent openings (not shown) in the second magnet 7. The second piston 62 remains in the open position.

To close the door, the circuit to the first magnet 6 is close causing the first solenoid valve element 78 to attract allowing pressure to flow through the first annular chamber 69 and into the first pilot passageways 48 and 48'. The non-return valve 31 is moved to the closed position and, by action on the first annular surface 76 of the first piston 61, the pistons 61 and 62 are reversed thus connecting the primary inlet 40 to the first outlet 41 by way of the inlet passageway 24 and the annular spaces 65 and 64. Simultaneously, the second outlet 42 is vented to atmosphere via the annular spaces 67 and 68 and the second vent opening 59.

When th electrical circuit to the first magnet 6 is again opened, the first solenoid valve element 78 returns to the seated position and the first pilot passageways 48 and 48' are vented through magnet vent openings (not shown) in the first magnet 6. The first piston 61 remains in the open position.

If, as a result of the switching of the emergency valve (not shown), there is a pressurization of the emergency inlet 51, whereby the primary inlet 40 is depressurized, the piston chamber 60 is pressurized via the shuttle valve 19, so that either the piston 61 or the piston 62 reverses, according to which position the door valve is currently in, so that either the first outlet 41 is vented via the annular spaces 63 and 64 or the second outlet 42 via the annular spaces 67 and 68.

Both outlets 41 and 42 are thereby depressurized, one having originally been vented by the position of the door while the other outlet 41 or 42 is vented by the shuttle valve 19 due to the emergency condition. If then the emergency inlet 51 connected with the emergency valve 1 is again vented, whereupon the primary inlet 40 is again pressurized, both the first piston 61 and the second piston 62 remain in their vented positions. Only by closing on of the two circuits does the first piston 61 or the second piston 62 reverse, and pressurize the corresponding outlet 41 or 42.

As a special feature of this door valve, it should be mentioned that the "shutoff" can be accomplished not only as described by pressurizing the emergency inlet 51, but also by the simultaneous excitation of the two magnets 6 and 7.

If this happens, the annular surfaces 76 and 77 and the piston chamber 60 are simultaneously pressurized. The piston surfaces thereby become active, so that either the piston 61 or the piston 62 reverses, and vents the appropriate outlet 41 or 42, whichever is pressurized.

During this switching procedure, pilot passageways 48, 48' and 49, 49' are pressurized, so that the shuttle passageway 32 is also pressurized via the non-return valve 31. The shuttle valve 19 blocks the connection to the emergency channel 51 so that air can flow into the piston chamber 60.

The resetting of the door valve into the normal position takes place as described above by triggering a pulse.

Having now described the invention what we claim as new and desire to secure by Letters Patent, is:

1. In combination a pneumatic door control arrangement and a door drive with a control chambers which move a door between an open and a closed position, comprising:

(a) a control valve having an opening solenoid-operated pilot valve and a closing solenoid-operated pilot valve selectively actuating respective opening and closing spool members to venting and operating positions such that fluid pressure can flow to said door drive to open and close a door, said spool members each having a pressure responsive surface associated therewith;

(b) safety switch means for sensing the occurrence of a differential operating pressure in said door drive;

(c) switching means for selectively energizing one of said solenoid-operated pilot valves in response to an operator-initiated control, and, for deenergizing said one solenoid-operated pilot valve and energizing the other of said solenoid-operated pilot valve in response to an output from said safety switching means while said door drive is closing a door, and for simultaneously energizing both of said solenoid-operated pilot valves in response to an output from said safety switching means while said door drive is opening a door; and (d) said control valve having a non-return valve means in communication with said opening and closing solenoid-operated pilot valves and operable to a center, open position upon simultaneous energization of said opening and closing solenoid-operated pilot valves for passing fluid pressure to said pressure responsive surfaces of said opening and closing spool members and actuating the one of said end opening and closing spool members in its operating position to its venting position to effect simultaneous venting by the spool members.

2. A pneumatic door control arrangement, as set forth in claim 1, wherein said pressure responsive surfaces are defined by opening and closing pistons reciprocably movable within opening and closing piston bores formed in said control valve.

3. A pneumatic door control arrangement, as set forth in claim 2, wherein said control valve further comprises a shuttle valve means for pneumatically positioning said opening and closing spool valves to respective vent positions in response to an emergency signal produced by manually initiated means.

4. A pneumatic door control arrangement as set forth in claim 1, wherein said opening and closing solenoid-operated pilot valves include opening and closing magnet portions and opening and closing solenoid portions.

5. A pneumatic door control arrangement, as set forth in claim 1, wherein said safety switch means includes a differential pressure switch connected to said control chambers to sense a difference in pressure between such control chambers and to output a safety signal to said switching means when such difference exceeds a predetermined level.

6. A pneumatic door control arrangement, as set forth in claim 1, wherein said switch means includes limit switches for sensing a door in an opened and a closed position.

7. A pneumatic door control arrangement, as set forth in claim 2, wherein said opening and closing pistons have annular abutting portions formed on opposing ends which abut within a contacting chamber formed in said control valve between said opening and closing piston bores such that, pressurization of said contacting chamber separates said opening and closing pistons into respective vent positions and, pressurization of an opposing side of said opening annular abutting portion moves said opening and closing pistons simultaneously into respective passage and vent positions and, pressurization of an opposing side of said closing annular abutting portion moves said opening and closing pistons simultaneously into respective vent and passage positions.

8. A pneumatic door control arrangment, as set forth in claim 7, wherein said control valve further comprises a shuttle valve means for positioning said opening and closing spool valves to respective vent positions in response to an emergency signal produced by manually initiated means, said shuttle valve means including a shuttle valve member and an output in communication with said contacting chamber.

9. A pneumatic door control arrangement, as set forth in claim 7, wherein said non-return valve means includes a non-return valve member, an input in communication with each of said solenoid-operated pilot valves and an output in communication with said contacting chamber.

10. a pneumatic door control arrangement, as set forth in claim 3, further comprising a two-position manually operable emergency valve defining said manually initiated means and connected to said control valve such that, in an emergency position, pressurized air is directed to said shuttle valve means and, in a normal position, pressurized air is directed to one of said solenoid-operated pilot valves in the passage position.

11. A pneumatic door control arrangement, as set forth in claim 10, further comprising a two-position throttle valve connected between said emergency valve and said control valve such that, following an emergency positioning of said emergency valve, pressurized air to said control valve is restricted, and, during normal positioning of said emergency valve, pressurized air to said control valve is unrestricted.

12. A pneumatic door control valve for operating a door drive with control chambers which move a door between an open and a closed position, comprising:

(a) a housing;

(b) opening and closing solenoid-operated pilot valves disposed in said housing for selectively actuating the door drive to open and close the door;

(c) opening and closing spool valves, each operable upon actuation of said opening and closing solenoid-operated pilot valves, to a passage and a vent position, said opening and closing spool valves having opening and closing pistons reciprocably movable within opening and closing piston bores formed in said housing;

(d) a contacting chamber formed between said opening and closing piston bores;

(e) said opening and closing pistons have annular abutting portions formed on opposing ends which abut within said contacting chamber such that, pressurization of said contacting chamber separates said opening and closing pistons into respective vent positions and, pressurization of an opposing side of said opening annular abutting portion moves said opening and closing spool valves simultaneously into respective passage and venting positions, and, pressurization of an opposing side of said closing annular abutting portion moves said opening and closing pistons simultaneously into respective vent and passage positions; and (f) non-return valve means in communication with said opening and closing solenoid-operated pilot valves for pressurizing said contacting chamber and positioning said opening and closing spool valves to respective vent positions upon simultaneous energization of said opening and closing solenoid-operated pilot valves to their passage position.

13. A pneumatic door control valve, as set forth in claim 12, wherein said opening and closing solenoid-operated pilot valves include opening and closing magnet portions and opening and closing solenoid portions.

14. A pneumatic door control valve, as set forth in claim 12, further comprising a shuttle valve means disposed in said housing for positioning said opening and closing spool valves to respective vent positions in response to an emergency signal produced by manually initiated means.

15. A pneumatic door control valve, as set forth in claim 14, wherein said shuttle valve means includes a shuttle valve member, and an output in communication with said contacting chamber.

16. A pneumatic door control valve, as set forth in claim 12, wherein said non-return valve means includes a non-return valve member, an input in communication with each of said solenoid-operated pilot valves, and an output in communication with said contacting chamber.

17. A pneumatic door control valve, as set forth in claim 12, wherein said non-return valve means is disposed intermediate said opening and closing solenoid-operated pilot valves.

18. A pneumatic door control valve, as set forth in claim 12, wherein said opening and closing annular abutting portions have greater effective piston surface areas than said opposing sides of said opening and closing annular abutting portions.

* * * * *

UNITED STATES PATENT AND TRADEMARK OFFICE

CERTIFICATE OF CORRECTION

PATENT NO. : 4,523,513

DATED : June 18, 1985

INVENTOR(S) : Wolfgang Gudat et al

It is certified that error appears in the above-identified patent and that said Letters Patent are hereby corrected as shown below:

Column 6, line 51, delete "a", second occurrence

Column 7, line 15, delete "end"

Column 8, line 5, change "a" to --A-- line 46, change "venting" to --vent--

Signed and Sealed this

*Twenty-second* Day of *October 1985*

[SEAL]

*Attest:*

DONALD J. QUIGG

*Attesting Officer*

*Commissioner of Patents and Trademarks—Designate*